US005619831A

United States Patent [19]

Reay

[11] Patent Number: 5,619,831

[45] Date of Patent: Apr. 15, 1997

[54] JOINT MEMBERS AND METHOD OF FORMING A JOINT

[75] Inventor: Alan M. Reay, Christchurch, New Zealand

[73] Assignee: Engineering Certifiers Limited, Christchurch, New Zealand

[21] Appl. No.: 518,198

[22] Filed: Aug. 23, 1995

[30] Foreign Application Priority Data

Aug. 26, 1994 [NZ] New Zealand ..... 264318

[51] Int. Cl.[6] ..... E04B 1/68; E01C 11/10

[52] U.S. Cl. ..... 52/396.04; 52/396.09; 52/402; 52/741.4; 52/742.16; 404/47; 404/64; 404/67

[58] Field of Search ..... 52/393, 396.04, 52/396.05, 396.08, 396.09, 402, 741.3, 741.4, 741.41, 742.1, 742.13, 742.14, 742.15, 742.16; 277/12, 168, 172, DIG. 10; 404/47, 64, 65, 67, 68, 69, 87, 89

[56] References Cited

U.S. PATENT DOCUMENTS

| | | | |
|---|---|---|---|
| D. 236,715 | 9/1975 | Patterson | 52/396.04 X |
| 3,283,674 | 11/1966 | Hahn | 404/67 |
| 3,604,169 | 9/1971 | Smith | 52/396.04 |
| 3,760,544 | 9/1973 | Hawes et al. | 52/396.04 X |
| 4,533,278 | 8/1985 | Corsover et al. | 52/396.04 X |
| 5,168,683 | 12/1992 | Sansom et al. | 52/396.04 |
| 5,197,250 | 3/1993 | Kramer | 52/396.04 |

FOREIGN PATENT DOCUMENTS

| | | | |
|---|---|---|---|
| 1280527 | 10/1968 | Germany | 52/396.04 |
| 2311421 | 9/1974 | Germany | 52/396.04 |
| 748436 | 5/1956 | United Kingdom | 52/396.04 |

*Primary Examiner*—Carl D. Friedman
*Assistant Examiner*—Kevin D. Wilkens
*Attorney, Agent, or Firm*—Ross, Ross & Flavin

[57] ABSTRACT

A method of forming a joint (2) and the member (8, 28) used therein between two cementitious faces (3, 4) in which the space between the faces is not of uniform cross-section, but has at least two different widths (5, 6) and is stepped with a shoulder (7). The joint member has a central upright portion (9), a lower portion or head (10) for positioning the member relative to the lower faces (5). The lower portion includes one or more sets of projections (14) which are resiliently deformable. Flanges 11 on either side of the central portion have limited movement relative to the central portion rest on the shoulder (7) of the faces when the space between the member and the faces 3, 4 is filled with a resilient but compressible product.

10 Claims, 2 Drawing Sheets

JOINT MEMBERS AND METHOD OF FORMING A JOINT

BACKGROUND OF THE INVENTION

The present invention relates to a joint member and a method of forming a joint between two stepped cementitious surfaces. It is of particular relevance to the joints in concrete floors.

Conventional concrete floors may require a joint system to allow for movement. There are a variety of known method of forming such joints: sealing joints with an elastomer to allow for movement; using an epoxy sealant; using a combination of the two types of fillers; or any of the above methods with a saw cut through the jointing material to allow for movement. These styles of filling provide support for the cementitious faces of the joint, but do not perform well or are expensive to construct.

An improvement in the method of forming a joint and the joint member to fit in a joint are disclosed in New Zealand Patent Nos 229154 and 247968. The method disclosed incorporates the insertion of an elongate divider plate means between two faces in a groove, channel or slot, the plate means having projections which bear against but not into the cementitious faces in order to provide two regions filled with a settable material. The joint member of New Zealand Patent No 247968 discloses such a divider plate means, with projections sloping upwardly and outwardly from a base to hold the joint member in place.

However both the method and the joint member described above cannot be used where the cementitious faces are necked, stepped or shouldered so that the joint, in cross-section, has two different widths. The use of, or creation of, such a cross-section and a joint member for use therein can be used to reduce the amount of setting material required, permit an increase in the width of a joint that can be repaired/made; and increase the range of joints which can be filled and thus protected from wear and tear of the edges of the blocks in a floor.

BRIEF SUMMARY OF THE INVENTION

An object of the present invention is the provision of a method of forming a joint between two cementitious, stepped surfaces which overcomes the disadvantages of the known methods described above. A further object of the present invention is the provision of an improved joint member.

The present invention provides a method of forming a joint between two cementitious faces along the length of the faces in which the space between said faces is not of a uniform cross-section but has at least two different widths and is stepped; said method comprising:

positioning a joint member between said faces, said joint member incorporating: a central upright portion; a lower portion attached to the lower end of the central portion for positioning the joint member relative to the lower walls of the faces; at least two flanges, one on each side of the central portion and secured thereto, said member being positioned such that a part or all of each flange rests on a shoulder or at the transition point between two differing widths of said faces, but do not touch the cementitious faces;

inserting a filling material between said joint member and each cementitious face such that the volume in the region of greatest width of the space between the faces is filled by said material, said flanges preventing any material falling below them; and allowing said filling material to mature or set to form a joint.

Said method can further comprise the step of forming the joint to the desired shape with one, two or three saw cuts, depending on the cross-sectional shape of the joint prior to the use of the method.

Preferably said filling material is one that is rigid yet retains a degree of compressibility, for example an epoxy resin or an elastomeric product.

The present invention further provides a joint member for positioning between cementitious faces in which the space between said faces is not of a uniform cross-section but has at least two different widths and is stepped; said joint comprising: a central upright portion; a lower portion attached to the lower end of the central portion for positioning the joint member relative to the lower walls of the faces; at least two flanges, one on each side of the central portion and secured thereto, said member being positioned such that a part or all of each flange rests on a shoulder or at the transition point between two differing widths of said faces, but do not touch the cementitious faces.

Preferably said joint member is formed integrally of one material which is flexible but reasonably self supporting, for example polyvinyl chloride. Preferably said flanges are hingedly secured to the central portion of the joint member and are capable of a limited amount of rotation about the joint.

BRIEF DESCRIPTION OF THE DRAWINGS

By way of example only, a preferred embodiments of the present invention are described in detail with reference to the accompanying drawings, in which.

DETAILED DESCRIPTION

Figure 1:
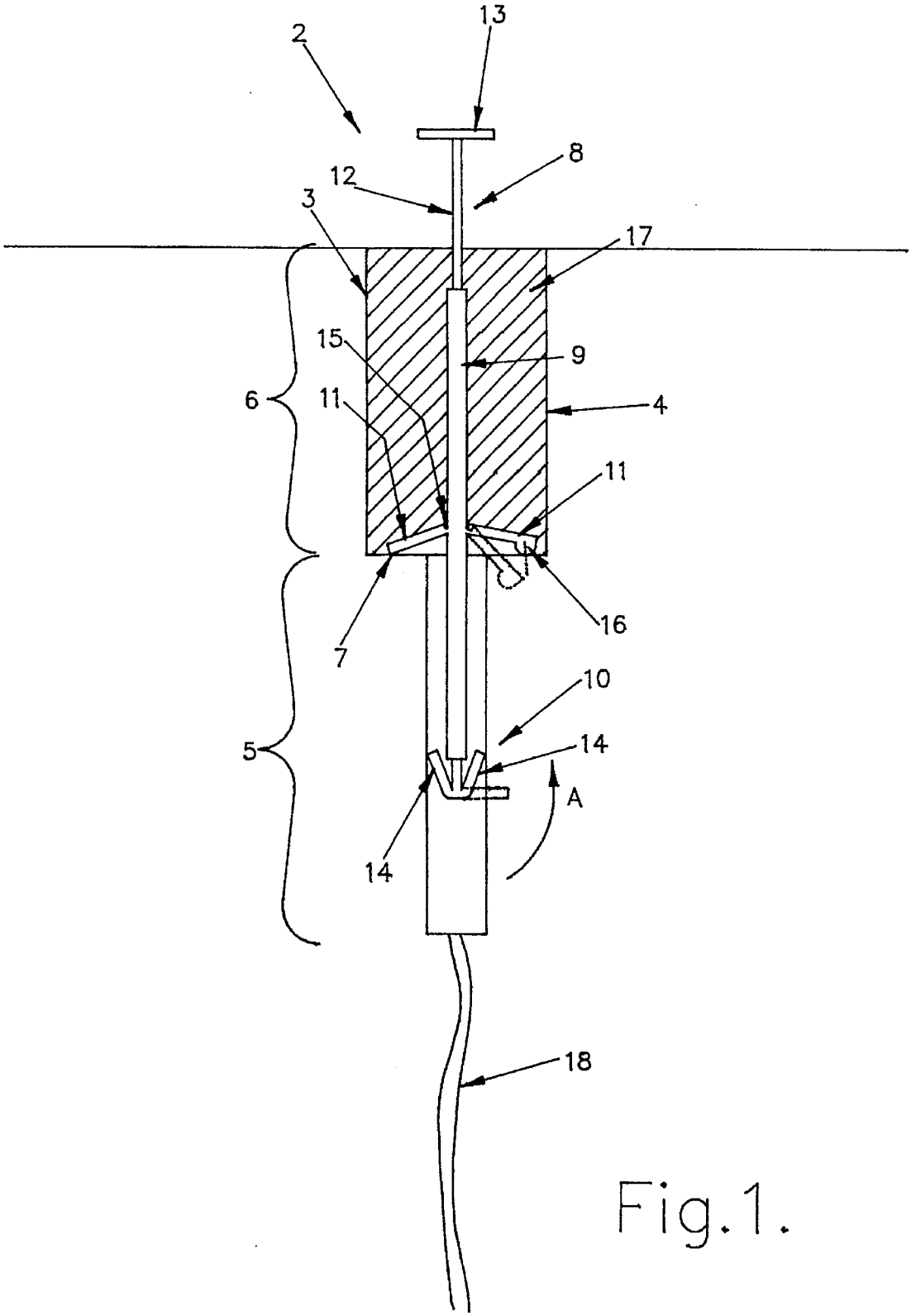
FIG. 1 is a cross-section through a stepped joint with a first preferred embodiment of the joint member of the present invention in position and the joint completed.

Referring to FIG. 1, a space 2 between two cementitious faces 3, 4 is thereshown. The space 2 incorporates two regions (a lower region 5 and an upper region 6) of differing widths. A shoulder 7 which is approximately horizontal, links the faces 3, 4 between the two regions 5, 6. The faces 3, 4 are approximately parallel in each region 5, 6.

A first embodiment of a joint member 8 is shown in position in the space 2. The member 8 includes a central upright portion 9, a locating head 10 and two side flanges 11. The central portion 9 is shown as including a top portion 12 with a handle 13. A part of the top portion 12 and handle 13 is shown as protruding above the level of the faces 3, 4. If so desired, the protruding part can be broken off once the joint is formed. Alternatively, if so desired, the top portion 12 can be omitted from the member 8 so that the central portion 9 extends to the surface, level with the top of the faces 3, 4 or slightly below (when the joint member 8 is in position in the space 2).

The locating head 10 is positioned at the bottom of the member 8. Said head 10 includes two side projections 14, with one projection 14 on opposing sides of the member 8, about a longitudinal axis (not shown) of the joint member 8.

The projections 14 are resilient and capable of upward movement in the direction shown by arrow A (relative to the central portion 9) when the member 8 is inserted into the space 2. The open or non-use position of the projections 14 is shown in dotted outline on the drawing. The width across from one end of one projection 14 to the opposite end of the opposed projection 14 is slightly greater than the width of the lower region 5 but less than the width of the upper region 6.

The side flanges 11 are positioned at least one or more on opposing sides of the central portion 9 about the longitudinal axis of the member 8 between the head 10 and top portion 12. In FIG. 1 two alternative embodiments of the shape of each said flange 11 are thereshown. In the first embodiment (on the left of FIG. 1) the shape of the flange 11 in cross-section is substantially rectangular. The flange 11 includes a necked area 15 which permits this area 15 to act as a hinge, allowing limited rotational movement of the flange 11 relative to the central portion 9. The width of each flange 11 is less than the distance from the longitudinal axis of the member 8 to a face (3 or 4) of the upper region 6. Thus the flanges 11 do not touch or bear against the faces 3 or 4 of the upper region 6, but touch or rest on the respective shoulder 7 between the two regions 5, 6.

The right hand flange 11 shows an alternative shape of the flange 11. The cross sectional shape of the flange 11 is rectangular with a semi-circular node 16 positioned on the underside of the flange 11 at the end remote from the central portion 9. The non-use or at rest position of the flange 11 relative to the central portion 9 is shown in dotted outline on the right hand flange 11.

Figure 2:
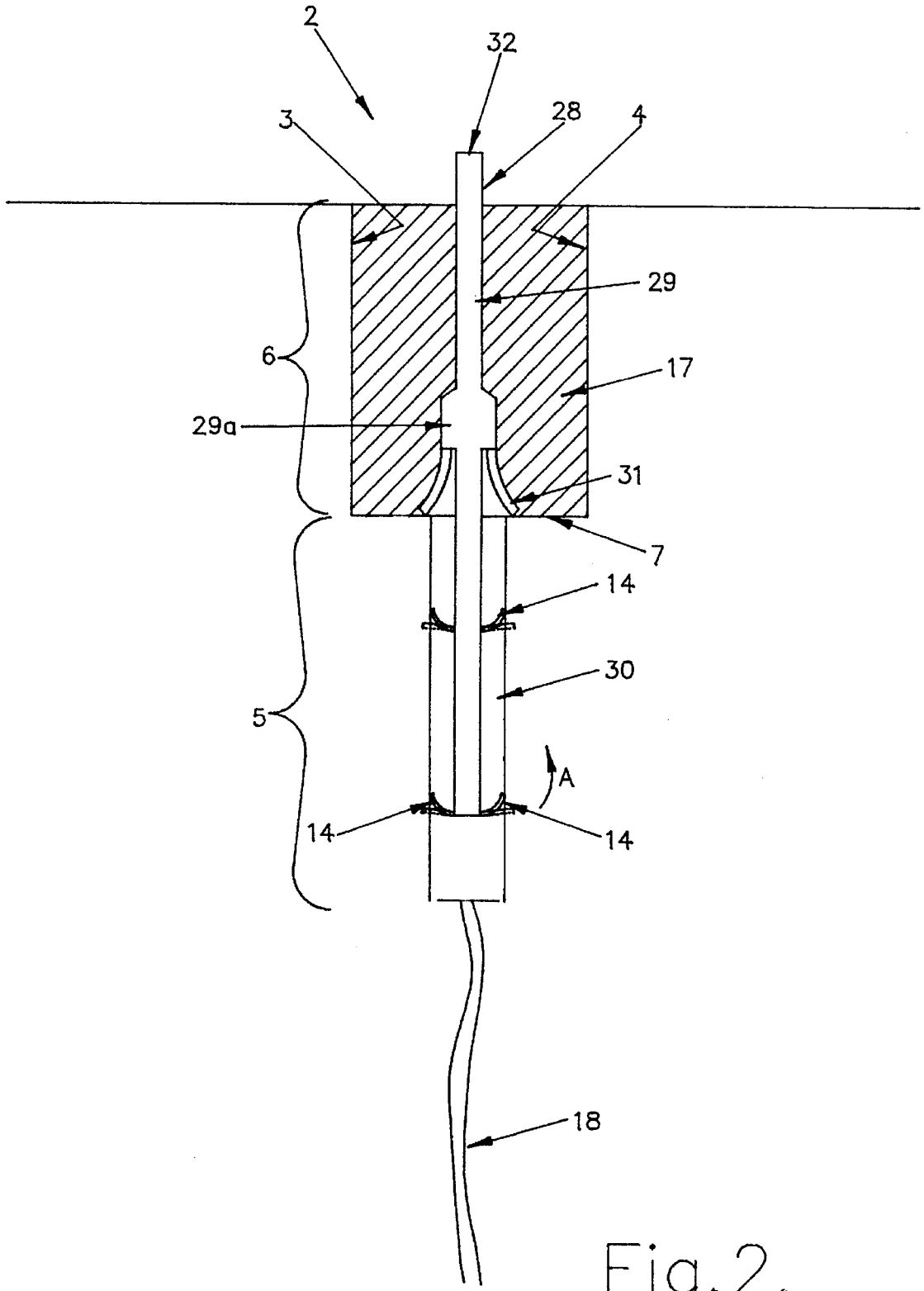
FIG. 2 is a cross-section through a second preferred embodiment of the joint member of the present invention in position and the joint complete.

Referring to FIG. 2, a second embodiment of the joint member 28 is thereshown. Parts with like numbers to the embodiment shown in FIG. 1 are like numbered. The member 28 includes a central upright portion 29, a locating head 30 and two side flanges 31. The central portion 29 includes a top portion 32. A part of this top portion 32 may protrude above the level of the faces 3, 4.

The locating head 30 includes two sets of side projections 14, one above the other on the head 30. Each set of projections 14 includes one projection 14 on opposing sides of the member 28, about a longitudinal axis (not shown) of the joint member 28.

The side flanges 31 are positioned at least one on opposing sides of the central portion 29 about the longitudinal axis of the member 28, and between the head portion 30 and top portion 32. The shape of each flange, in cross-section is arcuate and downwardly curved, so that when the member 28 is not in use the distance between the two outer ends of the flanges 31 is just great enough to rest on the shoulder 7. The end of the flanges 31 adjacent the central portion 29 of the member 28 are connected to a collar 29*a*, a thickened portion of the central portion 29. The flanges are of constant thickness along their length. The length of each flange 31 is such that the flange 31 does not touch the side walls 3, 4.

The joint member 8, 28 is made integrally, preferably of one material. However, the flanges 11, 31 may be of an alternative grade plastics material, if so desired, to provide the flanges 11, 31 with a greater degree of flexibility. The member 8, 28 can be made by injection or extrusion moulding, as is desired, or any other appropriate method. The member 8, 28 may be made of any appropriate long lasting resilient plastics material(s). An example of such material is polyvinyl chloride.

The joint member 8, 28 may be formed in pre-determined lengths of the described cross-sectional shape. Alternatively, if so desired, the member 8, 28 may be formed in indeterminate lengths and cut to suit the length of each space 2.

The above described joint member 8, 28 and method of forming a joint is as follows: the appropriately dimensioned space 2 is prepared. If the space 2 is to be formed along an expansion crack 18 in a concrete block or between two blocks of concrete, a saw or saws of appropriate radius and thickness can be used in known manner to cut and prepare the space 2. In practice it has been found that a space 2 with the following dimensions works well: an upper region 6 with a width 9 millimeters and depth between 10 to 15 millimeters; and a lower region with a width of 3 millimeters and a depth of 20 to 40 millimeters.

The joint member 8, 28 is inserted along the length of the space 2. The member 8, 28 is inserted to a depth sufficient for the projections 14 of the head 10 to engage with the surfaces of the lower region 5 of the space 2 and such that the flanges 11, 31 rest on the shoulder 7 of the space 2 along some or all of the underside of the flanges 11, 31. The filling material 17 is inserted into the spaces between the member 8, 28 and the faces 3, 4 of the upper region 6 of the space 2. The weight of the material 17 will tend to flatten the flanges 11, 31 slightly against the respective shoulder 7. The resilience of the projections 14 of the head 10, 30 and the shape of the flanges 11, 31 prevent the weight on the joint member 8, 28 from pushing the member 8, 28 further into the space 2.

In the embodiment shown in FIG. 1 the part of the top portion 12, 32 and handle 13 projecting above the top of the joint and top surface of the material 17 can be broken off or removed when the material 17 has set. If the joint member 8, 28 is dimensioned such that the top of the central portion 9 is level with the top of faces 3, 4, or slightly below this level, then a top portion 12, 32 will not be needed.

If so desired, the filling material 17 may actually be two separate materials—the space 2 being part filled with one material (which is allowed to set or mature) and then fully filled with a second material. As the joint member 8, 28 is of a material that can remain upright without further support the member 8, 28 will remain in the correct, upright position for such a process.

The filling material 17 may be any appropriate material suitable for use with concrete or cement products, and which is resilient and allows for some amount of movement, for example an epoxy resin or an elastomer.

I claim:

1. A method of forming a joint along the length of two confronting cementitious faces where the faces are necked or stepped or shouldered to provide a space therebetween of non-uniform cross section comprising:

positioning a joint member, consisting of a central upright portion and a lower portion depending from the lower extremity of the central upright portion and a flange secured to each side of the central upright portion, so that each flange rests upon the transition point between two differing widths of the faces;

inserting a filling material between the faces and around the joint member with the flanges precluding the dropping of any of the filling material therebelow;

allowing the filling material to set;

breaking off any protubering portion of the central upright portion of the joint member.

2. A method of forming a joint between two cementitious faces as claimed in claim 1 with the lower portion comprising a locating head with one or more sets of two side projections and each set having one projection on each side of the head, with the projections being resiliently deformable when the member is positioned between the faces and the projections being positioned below the shoulder of the faces when the member is in position.

3. A method of forming a joint between two cementitious faces as claimed in claim 1 with each flange being of rectangular cross-section with a necked portion between the flange and the upright portion and with the necked portion acting as a hinge to allow limited rotational movement of the flange relative to the central portion.

4. A method of forming a joint between two cementitious faces as claimed in claim 1 with each flange further comprising a semi-circular node on the underside of the edge of the flange remote from the central portion.

5. A joint member for forming a joint along the length of two confronting cementitious wherein the space between the faces is stepped, of non-uniform cross-section, and is filled with a filler, the joint member comprising:

a central upright portion;

a lower portion attached to the lower end of the central upright portion for the positioning of the joint member relative to the lower walls of the faces;

a flange extending from each side of the central upright portion;

the joint member being positioned such that a part or all of each flange rests at the transition point between two differing widths of the faces;

any part of the central upright portion protubering above the level of the filling being frangible and breakable from the remainder of the central portion.

6. A joint member for positioning between cementitious faces as claimed in claim 5, the lower portion comprising a locating head with one or more sets of two side projections, each set having one projection on each side of the head, the projections being resiliently deformable when the member is positioned between the faces and the projections being positioned below the shoulders of the faces when the member is in position.

7. A joint member for positioning between cementitious faces as claimed in claim 5, each flange being of rectangular cross-section with a necked portion between the flange and the upright portion, the necked portion acting as a hinge to allow limited rotational movement of the flange relative to the central portion.

8. A joint member for positioning between cementitious faces as claimed in claim 5, the joint being formed integrally from one material.

9. A joint member for positioning between cementitious faces as claimed in claim 8, the material being a polyvinyl chloride.

10. A joint provided between two cementitious faces in which the space between the faces is of non uniform cross-section with at least two different widths and is stepped: the joint comprising: a joint member as claimed in claim 5; a filling material between the joint member and each cementitious face such that the volume in the region of greatest width of the space between the faces is filled by the material, the flanges preventing any material falling below them.

* * * * *